US005525293A

United States Patent [19]

Kagawa et al.

[11] Patent Number: 5,525,293

[45] Date of Patent: Jun. 11, 1996

[54] POWDER METALLURGICAL BINDER AND POWDER METALLURGICAL MIXED POWDER

[75] Inventors: Akihiko Kagawa, Takasago; Kazuhisa Fujisawa, Kobe; Hironori Suzuki, Takasago; Masahiro Murakami, Takasago; Kunihiro Yoshioka, Takasago; Hirotaka Hanaoka, Takasago, all of Japan

[73] Assignee: Kabushiki Kaisha Kobe Seiko Sho, Kobe, Japan

[21] Appl. No.: 336,051

[22] Filed: Nov. 4, 1994

[30] Foreign Application Priority Data

Nov. 4, 1993 [JP] Japan ..... 5-275585
Aug. 26, 1994 [JP] Japan ..... 6-202044

[51] Int. Cl.[6] ..... B22F 1/00

[52] U.S. Cl. ..... 419/65; 419/36; 75/228; 75/255

[58] Field of Search ..... 419/65, 36; 75/228, 75/255

[56] References Cited

U.S. PATENT DOCUMENTS

| | | | |
|---|---|---|---|
| 4,403,007 | 9/1983 | Coughlin | 428/95 |
| 4,483,905 | 11/1984 | Engstrom | 428/570 |
| 4,866,023 | 9/1989 | Ritter et al. | 502/174 |
| 4,898,902 | 2/1990 | Nagai et al. | 524/275 |
| 4,946,884 | 8/1990 | Kuphal et al. | 524/403 |
| 5,091,346 | 2/1992 | Inoue et al. | 501/93 |
| 5,194,203 | 3/1993 | Kankawa et al. | 264/63 |
| 5,290,336 | 3/1994 | Luk | 75/231 |
| 5,298,055 | 3/1994 | Semel et al. | 75/252 |
| 5,380,179 | 1/1995 | Nishimura et al. | 419/36 |
| 5,421,853 | 6/1995 | Chen et al. | 75/252 |

*Primary Examiner*—Donald P. Walsh
*Assistant Examiner*—Scott T. Bluni
*Attorney, Agent, or Firm*—Oblon, Spivak, McClelland, Maier & Neustadt

[57] ABSTRACT

Disclosed is a powder metallurgical mixed powder capable of preventing the defective dispersion, that is, the segregation of physical property improving powders and a lubricant powder without reduction in lubricity, and of suppressing the generation of dust upon handling of powders; and a powder metallurgical binder capable of realizing such a mixed powder. The binder including a copolymer containing monomer components of ethylene and propylene, which may be combined with a liquid binder having a specified composition as needed, is added to a powder metallurgical raw powder.

16 Claims, 1 Drawing Sheet

POWDER METALLURGICAL BINDER AND POWDER METALLURGICAL MIXED POWDER

BACKGROUND OF THE INVENTION

1. Field of the Invention

The present invention relates to a binder having a specified composition, which is added to a powder metallurgical raw powder, mainly containing a metal powder such as iron powder or steel powder incorporated with alloy powders and graphite as components of improving the physical properties and a lubricant powder such as zinc stearate, for suppressing the segregation of the physical property improving powders and the lubricant powder without degradation of the physical properties of the metal powder as the main component, suppressing the generation of dust in handling of powders, and suppressing the deterioration of the lubricity.

2. Description of the Related Art

In manufacturing sintered structure parts, etc. from a powder metallurgical raw powder mainly containing a metal powder such as iron powder or steel powder, the raw powder is usually added with alloy powders such as copper, nickel, chromium, molybdenum and powders of graphite, phosphorus and sulfur for improving the physical properties (strength characteristics, machinability, etc.) of the sintered body, and a lubricant powder such as zinc stearate. However, the above physical property improving powders and the lubricant powder are usually very different in particle size and specific gravity from each other. For example, where the main metal powder is iron powder or steel powder and the physical property improving components are graphite and phosphorus, they are significantly different in specific gravity from each other, which tends to generate dust and segregation in the handling step until compaction after mixing. To solve this problem, various attempts have been made for a long time.

The generation of dust is mainly due to fine powders having small specific gravities such as graphite powder, and it not only causes an environmental problem in handling of powders but also reduces the yield. The segregation tends to be generated where powders different in specific gravity and particle size from each other are mixed. For example, it is well known that when a mixed powder is discharged from a hopper, the mixing ratio of alloy powders is changed depending on the elapsed time during the discharge by the effect of the segregation.

To prevent the generation of dust and segregation, various methods have been proposed. These are generally classified into the following three types: The first method involves the step of adding a liquid additive such as tall oil to a raw powder, as is disclosed in Unexamined Japanese Patent Publication No. SHO 60-502158. The second method involves the step of dissolving a solid binder with solvent and uniformly mixing it with a raw powder, and then evaporating the solvent, as is disclosed in Unexamined Japanese Patent Publication Nos. SHO 63-103001 and HEI 2-217403. The third method is the so-called hot melt process in which a solid binder is melted in mixing with a raw powder, as is disclosed in Unexamined Japanese Patent Publication No. HEI 1-219101. In particular, the second method is known to be excellent in improvement of the adhesive strength of graphite powder and in wide selection of the kind of lubricant.

These methods are all excellent in preventing the generation of dust and segregation, however, they have the following disadvantages: The first method is disadvantageous in that the angle of repose of a mixed powder is increased, to deteriorate the flowability, thus easily generating the so-called bridging phenomenon upon the discharge of powders from a hopper. Where graphite powder is deposited on the surface of each particle of a metal powder such as iron powder, the flowability of the mixed powder is improved, but the lubricity of the graphite powder is deteriorated so that the friction between a die and powders or between powders upon compaction is increased, thereby deteriorating the lubricity of the mixed powder compared with the usual mixed powder. The second and third methods using a solid binder are disadvantageous in that the decomposition of the binder is often made poor, that is, the decomposition of the binder in the dewaxing process is made insufficient, with a result that the remainder possibly presents in a sintered body.

The conventional graphite segregation preventive powder is capable of preventing the generation of dust and segregation of graphite powder and having a flowability being not poor so much; however, it is inconvenient in deteriorating the lubricity of the graphite powder, thereby failing to achieve the good lubricity of the mixed powder upon compaction.

SUMMARY OF THE INVENTION

An object of the present invention is to provide a powder metallurgical mixed powder capable of preventing the defective dispersion, that is, the segregation of physical property improving powders and a lubricant powder without reduction in lubricity, and of suppressing the generation of dust upon handling of powders; and a powder metallurgical binder capable of realizing such a mixed powder.

To achieve the above object, according to a first aspect of the present invention, there is provided a binder to be added to a powder metallurgical raw powder, which includes a copolymer containing monomer components of ethylene and propylene.

To achieve the above object, according to a second aspect of the present invention, there is provided a powder metallurgical mixed powder obtained by the addition of the above binder to a powder metallurgical raw powder.

By adding, to a powder metallurgical raw powder, the above binder in combination with (A) a liquid fatty acid ester having an iodine number of 100 or less and a viscosity at 100° F. of 50 cST or less, and/or (B) a liquid fatty acid having an iodine number of 15 or less and a viscosity at 100° F. of 50 cST or less, it becomes possible to further improve the segregation preventing effect and the flowability of the mixed powder.

DETAILED DESCRIPTION OF THE PREFERRED EMBODIMENTS

Figure 1:
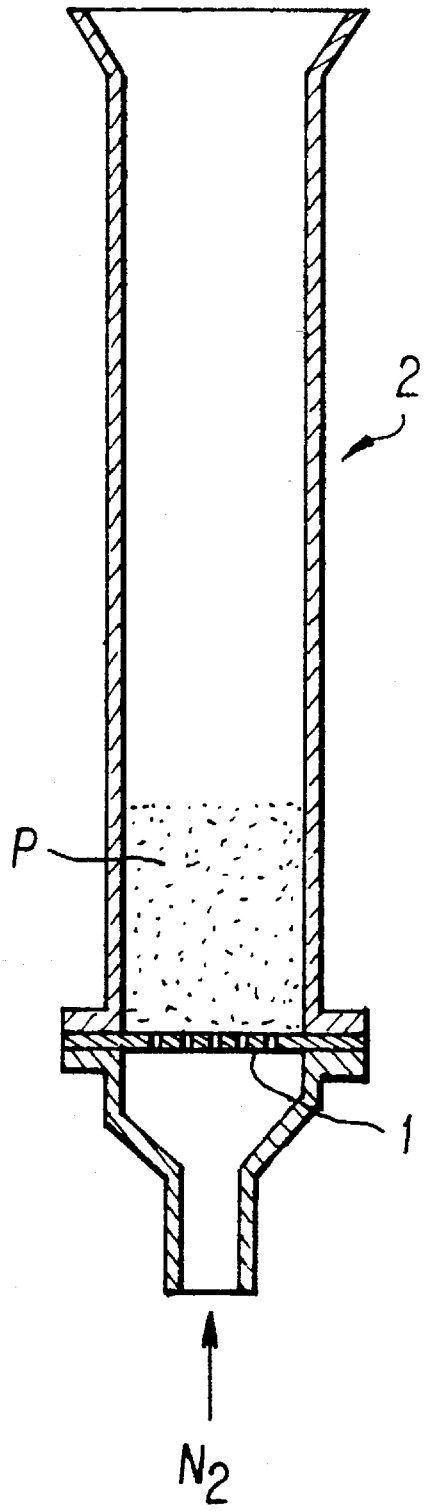
FIG. 1 is a sectional view of an apparatus used for measurement of graphite deposit ratio.

The present inventors have studied to solve the above-described problems of the prior arts, and found that the problems can be solved using the above-described specified copolymer as a binder. Namely, it was verified that the above binder makes it possible to effectively prevent the segregation of physical property improving powders and a lubricant powder without any reduction of the lubricity of a base metal powder, and to suppress the generation of dust upon handling of the mixed powder. The above binder has also the feature that the binder is easily decomposed in the dewaxing process and thereby the remainder is difficult to present in a sintered body.

The binder of the present invention includes a copolymer containing monomer components of ethylene and propylene. The mixing ratio in copolymerization between ethylene and propylene is preferably 20–80:80–20 (parts by weight). When the mixing ratio of ethylene is less than 20 parts by weight (namely, when the mixing ratio of propylene is more than 80 parts by weight), the scattering of graphite is suppressed, but the flowability of the mixed powder is deteriorated, thus causing a problem in terms of the compactibility of a green compact. On the other hand, when the mixing ratio of ethylene is more than 80 parts by weight (namely, when the mixing ratio of propylene is less than 20 parts by weight), the scattering of graphite cannot be sufficiently suppressed, thus failing to satisfactorily achieve the function of the binder.

The weight-average molecular weight of the above copolymer is preferably in the range of from 10,000 to 1,000,000, more preferably, from 50,000 to 500,000 . When it is excessively small, the function of the binder becomes insufficient. When it is excessively large, the nonuniformity of mixing is generated, which fails to satisfactorily achieve the segregation preventing effect.

The mixed powder can be obtained by the addition of the above binder to a powder metallurgical raw powder. In this mixing, the added amount of the binder is preferably in the range of from 0.05 to 0.5 wt %. When it is less than 0.05 wt %, the function of the binder cannot be achieved, that is, the graphite deposit on the surface of each particle of a metal powder becomes insufficient, thus lowering the graphite segregation preventive effect. When it is more 0.5 wt %, the compactibility is lowered, and thereby the green density of the mixed powder is reduced.

The present inventors have studied a powder metallurgical binder capable of improving the segregation preventive effect and the flowability of a mixed powder, and have proposed various powder metallurgical liquid binders, as disclosed in Unexamined Japanese Patent Publication Nos. HEI 6-93302 and HEI 6-40503. The binder described in the former document is a powder metallurgical liquid binder comprising a liquid fatty acid ester having an iodine number of 100 or less and a viscosity at 100° F. of 50 cST or less. The binder in the latter document is a powder metallurgical liquid binder comprising a liquid fatty acid having an iodine number of 15 or less and a viscosity at 100° F. of 50 cST or less. In these documents, the present inventors have also proposed a powder metallurgical mixed powder containing each of the above powder metallurgical liquid binders in combination with a solid binder comprising a styrene based synthetic rubber copolymer containing monomer components of styrene and butadiene. However, as shown in these documents, the above liquid binder in combination with the solid binder tends to slightly lower the flowability of the mixed powder. Moreover, the solid binder having the above composition is often deteriorated in the decomposition ability, that is, being insufficiently decomposed in the dewaxing process, which causes an inconvenience in allowing the remainder to present in a sintered body.

On the contrary, by adding, to a powder metallurgical raw powder, the inventive binder, that is, the powder metallurgical solid binder comprising the copolymer containing monomer components of ethylene and propylene in combination with the previously proposed powder metallurgical liquid binder (liquid fatty acid ester and/or liquid fatty acid), it becomes possible to realize a mixed powder further improved in the segregation preventive effect and the flowability without any of the above problems.

The procedure of preparing a mixed powder using the inventive solid binder in combination with the previously proposed liquid binder is not particularly limited. The inventive solid binder and the above liquid binder may be sequentially added to a powder metallurgical raw powder; or the solid binder and the liquid binder may be previously mixed, and then the mixed binder may be added to the raw powder. In either mixing procedure, preferably, the mixing ratio of the liquid fatty acid ester and/or liquid fatty acid in the liquid binder is in the range of from 0.01 to 0.2 wt % on the basis of the weight of the mixed powder. When it is less than 0.01 wt %, the effect of the powder metallurgical liquid binder cannot be achieved. When it is more than 0.2 wt %, the compactibility is lowered and thereby the green density of the mixed powder is reduced.

The liquid fatty acid ester constituting the above powder metallurgical liquid binder, which is used in combination of the inventive solid binder as needed, may include esters produced by the dehydration between monohydric alcohols (such as oleyl alcohol and stearyl alcohol), and/or polyhydric alcohols (such as ethylene glycol, propylene glycol, glycerol, sorbitan, pentaerythritol, dipentaerythritol, and trimethylolpropane), and higher fatty acids (such as lauric acid, stearic acid, olein acid, erucic acid, ricinolic acid, and hydroxystearic acid). One kind or more fatty acid esters may be added. The mixed ester obtained by the dehydration between two kinds of fatty acids and alcohol may be used. On the other hand, the liquid fatty acid constituting the above powder metallurgical liquid binder may include fatty acids such as caproic acid and valeric acid, other than the above-described higher fatty acids.

Hereinafter, the present invention will be described in details by way of example; however, it is not limited thereto. Accordingly, it is to be understood that changes and modifications are intended to be within the technical scope of the present invention.

EXAMPLE 1

An iron powder (an average particle size: 70 μm) was added with a graphite powder (natural graphite, an average particle size: 3 μm) and a copper powder (atomized copper powder, an average particle size: 30 μm) in respective amounts of 0.8 wt % and 2.0 wt % on the basis of the total weight of the mixed powder. These powder were mixed for 2 min using a high speed mixer. Subsequently, each of the following binders was diluted with toluene to form a 8% dilute solution, which was added to the mixed powder in an amount of 2 wt % on the basis of the total weight of the mixed powder, thus preparing each sample powder (Sample Nos. 1 to 4). The usual mixed powder (Sample No. 5) with no binder was also prepared.

(kind of binder)

Sample No. 1: ethylene-propylene copolymer mixing ratio (parts by weight): 80:20, weight-average molecular weight: about 100,000

Sample No. 2: ethylene-propylene copolymer mixing ratio (parts by weight): 50:50, weight-average molecular weight: about 100,000

Sample No. 3: ethylene-propylene copolymer mixing ratio (parts by weight): 20:80, weight-average molecular weight: about 100,000

Sample No. 4: styrene-butadiene copolymer mixing ratio (parts by weight): 70:30, weight-average molecular weight: about 100,000

Next, the mixer was evacuated, and the solvent of the mixed powder was evaporated while the mixed powder was agitated for 1 min, thereby depositing each particle of the graphite powder on the surface of each particle of the iron powder. This mixed powder was taken as the primary sample powder for measuring graphite deposit ratio. Finally, the mixed powder (primary sample powder) was added with a lubricant (zinc stearate, average particle size: 30 μm) in an amount of 0.75 wt % on the basis of the total weight of the mixed powder, and then mixed for 2 min. The resultant mixed powder was taken as the secondary sample powder for examining the characteristics of the mixed powder and a green compact.

The above primary sample powder was measured for the graphite deposit ratio by an air flow method using a funnel-shaped tube 2 (inside diameter: 16 mm, height: 106 mm) having a nucle-pore filter 1 (mesh: 12 μm) as shown in FIG. 1. Namely, the sample powder P (25 g) was put in the tube 2 and $N_2$ gas was supplied from the bottom for 20 min at a flow rate of 0.8 l/min. The graphite deposit ratio was calculated in the following equation, and the results were shown in Table 1 together with the kinds of the binders.

graphite deposit ratio (%)=[analysis value (%) of carbon after communication of $N_2$ gas/analysis value (%) of carbon before communication of $N_2$ gas]×100

TABLE 1

| Sample No. | Kind of binder (mixing ratio, parts by weight) | Graphite deposit ratio (%) | Remark |
|---|---|---|---|
| 1 | Ethylene-propylene copolymer (80:20) | 100 | Inventive example |
| 2 | Ethylene-propylene copolymer (50:50) | 100 | Inventive example |
| 3 | Ethylene-propylene copolymer (20:80) | 100 | Inventive example |
| 4 | Styrene-butadiene copolymer (70:30) | 100 | Comparative example |
| 5 | No addition | 41 | Comparative example |

As is apparent from Table 1, the mixed powder added with the binder composed of the ethylene-propylene copolymer was superior in the graphite deposit ratio to the usual mixed powder with no binder, irrespective of the mixing ratio of ethylene and propylene.

Next, the characteristics (apparent density and flowability) of the mixed powder and the characteristics (green density, rattler value, and ejecting pressure) of the green compact were measured using the above secondary sample powder. The apparent density and the flowability were measured in accordance with JIS-Z2504 and JIS-Z2502, respectively. The green density and rattler value were measured using a green compact obtained by filling a die having an inside diameter of 11.28 mm with 7 g of a sample powder and compacting the sample powder at a pressure of 5 ton/cm$^2$. The ejecting pressure was measured by filling a ring-like die having an outside diameter of 30 mm and an inside diameter of 10 mm with 50 g of a sample powder, and compacting the sample powder at 5 ton/cm$^2$; and measuring the ejecting force per unit area upon ejecting the green compact from the die. The results are shown in Table 2.

TABLE 2

| Sample No. | Kind of binder (mixing ratio) | Apparent density (g/cm$^3$) | Flow-ability (sec/50 g) | Green density (g/cm$^3$) | Rattler value (%) | Ejecting pressure (kgf/cm$^2$) | Remark |
|---|---|---|---|---|---|---|---|
| 1 | Ethylene-propylene copolymer (80:20) | 3.45 | 22.5 | 6.88 | 0.80 | 113.0 | Inventive example |
| 2 | Ethylene-propylene copolymer (50:50) | 3.29 | 23.4 | 6.90 | 0.65 | 120.1 | Inventive example |
| 3 | Ethylene-propylene copolymer (20:80) | 3.22 | 24.5 | 6.91 | 0.62 | 124.2 | Inventive example |
| 4 | Styrene-butadiene copolymer (70:30) | 3.47 | 25.4 | 6.86 | 0.89 | 135.9 | Comparative example |
| 6 | No addition | 3.31 | 34.1 | 6.86 | 0.92 | 144.2 | Comparative example |

As is apparent from Table 2, the mixed powders of the inventive examples (Sample Nos. 1 to 3) are superior to the mixed powders of the comparative examples (Sample Nos. 4 and 5) in the terms of the flowability, compactibility and ejecting pressure. In addition, there is a relationship between the mixing ratio of ethylene to propylene and the characteristics of the mixed powder. As the amount of ethylene is increased, the apparent density is increased, and the flowability and the ejecting pressure are reduced.

EXAMPLE 2

An iron powder (an average particle size: 70 μm) was added with a graphite powder (natural graphite, an average particle size: 3 μm) and a copper powder (atomized copper powder, an average particle size: 30 μm) in respective amounts of 0.8 wt % and 2.0 wt % on the basis of the total weight of the mixed powder. These powders were mixed for 2 min in a high speed mixer. Subsequently, an ethylene-propylene copolymer binder [mixing ratio (parts by weight); ethylene: propylene=80:20, weight-average molecular weight; about 100,000) was diluted with toluene to form a 8% solution, which was added to the above mixed powder in an amount of 0.5 wt % on the basis of the total weight of the mixed powder, thus preparing a sample powder (Sample No. 6) in which the solid content was added to the mixed powder in an amount of 0.04 wt %. Similarly, the other samples were prepared: Sample No. 7 (solid content of binder: 0.08 wt %); Sample No. 8 (0.16 wt %); Sample No. 9 (0.24 wt %); Sample No. 10 (0.40 wt %); and Sample No. 11 (0.56 wt %).

Next, the mixer was evacuated, and the solvent of the mixed powder was evaporated while the mixed powder was agitated for 15 min, thereby depositing each particle of the graphite powder on the surface of each particle of the iron powder. This mixed powder was taken as the primary sample powder for measuring graphite deposit ratio. Finally, a lubricant (zinc stearate, average particle size: 30 μm) was added to the mixed powder (primary sample powder) in an amount of 0.75 wt % on the basis of the total weight of the mixed powder, and then mixed for 2 min. The mixed powder was taken as the secondary sample powder for examining the characteristics of the mixed powder and the green compact.

The graphite deposit ratio was measured by an air flow method using the primary sample powder. The results are shown in Table 3. The characteristics of the mixed powder and the green compact were measured using the secondary sample powder. The results are shown in Table 4 together with the added amount of the binder.

TABLE 3

| Sample No. | Added amount of binder (wt %) | Graphite deposit ratio (%) | Remark |
|---|---|---|---|
| 6 | 0.04 | 73 | Comparative example |
| 7 | 0.08 | 92 | Inventive example |
| 8 | 0.16 | 100 | Inventive example |
| 9 | 0.24 | 100 | Inventive example |
| 10 | 0.40 | 100 | Inventive example |
| 11 | 0.56 | 100 | Comparative example |

TABLE 4

| Sample No. | Added amount of binder (wt %) | Apparent density (g/cm$^3$) | Flow-ability (sec/50 g) | Green density (g/cm$^3$) | Rattler value (%) | Ejecting pressure (kgf/cm$^2$) | Remark |
|---|---|---|---|---|---|---|---|
| 6 | 0.04 | 3.28 | 24.8 | 6.86 | 0.88 | 133.0 | Comparative example |
| 7 | 0.08 | 3.39 | 23.6 | 6.87 | 0.82 | 126.1 | Inventive example |
| 8 | 0.16 | 3.45 | 22.5 | 6.88 | 0.80 | 113.0 | Inventive example |
| 9 | 0.24 | 3.47 | 22.2 | 6.88 | 0.74 | 112.9 | Inventive example |
| 10 | 0.40 | 3.51 | 21.3 | 6.85 | 0.72 | 113.6 | Inventive example |
| 11 | 0.56 | 3.50 | 21.1 | 6.78 | 0.66 | 108.5 | Comparative example |

As is apparent from Tables 3 and 4, when the added amount of the binder is less than 0.05 wt % or less (Sample No. 6), the graphite deposit ratio is insufficient, and thereby the graphite segregation preventive effect becomes small. When it is more than 0.5 wt % (Sample No. 11), the compactibility is reduced.

EXAMPLE 3

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, each of fatty acid esters, which have a constant viscosity (viscosity at 100° F.: 25 cST) and the iodine number of 4 (Sample No. 12), 45 (Sample No. 13), 90 (Sample No. 14) and 130 (Sample No. 15), was added to the above mixed powder in an amount of 0.08 wt % on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder and the characteristics (apparent density and flowability) of the mixed powder were examined using the above secondary sample powder in the same manner as in Example 1. At this time, the segregation degrees of graphite powder and copper powder were also examined in the following manner: namely, 500 g of the mixed powder was compacted using a continuous press; 10 pieces of samples compacted in one hopper were taken at equal intervals; the amounts of graphite and copper powder in each sample were measured; and the difference between the maximum value and the minimum value was taken as the segregation degree. Additionally, the apparent density and the flowability were measured after an elapse of three days since manufacture.

The results are shown in Table 5. In Table 5, there are shown the results of the sample (Sample No. 16) using only ethylene-propylene copolymer (solid binder) as a binder and the sample (Sample No. 17) using only the fatty acid ester (liquid binder).

TABLE 5

| Sample No. | Solid binder | Iodine number of liquid binder | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 12 | Ethylene- | 4 | 100 | 0.03 | 0.18 | 3.43 | 22.7 | Inventive |

TABLE 5-continued

| Sample No. | Solid binder | Iodine number of liquid binder | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| | propylene | | | | | | | example |
| 13 | Ethylene-propylene | 45 | 100 | 0.02 | 0.16 | 3.47 | 24.8 | Inventive example |
| 14 | Ethylene-propylene | 90 | 99 | 0.01 | 0.15 | 3.38 | 27.3 | Inventive example |
| 15 | Ethylene-propylene | 130 | 100 | 0.04 | 0.24 | 3.45 | 26.3 | Comparative example |
| 16 | Ethylene-propylene | No addition | 100 | 0.03 | 0.32 | 3.45 | 22.5 | Inventive example |
| 17 | No addition | 90 | 69 | 0.01 | 0.16 | 3.37 | 32.7 | Comparative example |

As is apparent from Table 5, the solid binder composed of the ethylene-propylene copolymer in combination with the liquid binder composed of the fatty acid ester is very effective to improve the characteristics of the mixed powder.

Next, to examine the change of the characteristics of the mixed powder with time, Sample Nos. 12 to 15 were measured for the apparent density and the flowability under the condition of changing the elapsed days after the manufacture. The results are shown in Tables 6 and 7.

As is apparent from Tables 6 and 7, there is a close relationship between the iodine number of the fatty acid ester and the change in the characteristics of the mixed powder with time. In the sample powder using the fatty acid ester having the iodine number of 100 or less, the apparent density and the flowability is little changed after two months. On the contrary, in the sample powder using the fatty acid ester having the iodine number of more than 100, the apparent density is greatly reduced and the flowability is significantly deteriorated with time.

TABLE 6

| | | | Elapsed days after manufacture and apparent density (g/cm$^3$) | | | | | | |
|---|---|---|---|---|---|---|---|---|---|
| Sample No. | Solid binder | Iodine number of liquid binder | After 1 day | After 3 days | After 7 days | After 10 days | After 30 days | After 60 days | Remark |
| 12 | Ethylene-propylene | 4 | 3.42 | 3.43 | 3.43 | 3.43 | 3.40 | 3.41 | Inventive example |
| 13 | Ethylene-propylene | 45 | 3.47 | 3.47 | 3.48 | 3.45 | 3.47 | 3.46 | Inventive example |
| 14 | Ethylene-propylene | 90 | 3.39 | 3.38 | 3.37 | 3.35 | 3.32 | 3.33 | Inventive example |
| 15 | Ethylene-propylene | 130 | 3.48 | 3.45 | 3.40 | 3.36 | 3.27 | 3.21 | Comparative example |

TABLE 7

| | | | Elapsed days after manufacture and flowability (sec/50 g) | | | | | | |
|---|---|---|---|---|---|---|---|---|---|
| Sample No. | Solid binder | Iodine number of liquid binder | After 1 day | After 3 days | After 7 days | After 10 days | After 30 days | After 60 days | Remark |
| 12 | Ethylene-propylene | 4 | 22.5 | 22.7 | 22.9 | 23.3 | 23.7 | 22.8 | Inventive example |
| 13 | Ethylene-propylene | 45 | 24.6 | 24.8 | 24.2 | 25.1 | 24.8 | 24.5 | Inventive example |

TABLE 7-continued

| Sample No. | Solid binder | Iodine number of liquid binder | Elapsed days after manufacture and flowability (sec/50 g) After 1 day | After 3 days | After 7 days | After 10 days | After 30 days | After 60 days | Remark |
|---|---|---|---|---|---|---|---|---|---|
| 14 | Ethylene-propylene | 90 | 25.5 | 27.3 | 27.2 | 24.1 | 24.9 | 25.6 | Inventive example |
| 15 | Ethylene-propylene | 130 | 25.1 | 26.8 | 28.2 | 30.4 | 33.2 | Not flow | Comparative example |

The iodine number is obtained by applying halogen to a sample (100 g), measuring the absorption amount of the halogen, and converting it in the iodine amount (g). For the fatty acid ester, the iodine number is proportional to the amount of the unsaturated bonds. When the amount of the unsaturated bonds is increased, the unsaturated bonds react with oxygen. Namely, as the iodine number is higher in the fatty acid ester, the fatty acid ester is easily oxidized and deteriorated. This reduces the apparent density of the mixed powder and deteriorates the flowability thereof. In the present invention, the iodine number of the fatty acid ester is thus specified at 100 or less for suppressing the change in the apparent density and flowability of the mixed powder with time.

EXAMPLE 4

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, each of fatty acid esters, which have a constant iodine number of 77 and the viscosity at 100° F. of 7 cST (Sample No. 18), 15 cST (Sample No. 19), 26 cST (Sample No. 20) and 80 cST (Sample No. 21), was added to the above mixed powder in an amount of 0.08 wt % on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder in the manner as in Example 1 and the characteristics (apparent density and flowability) of the mixed powder were examined using the above secondary sample powder in the same manner as in Example 3. Table 8 shows the results of the graphite deposit ratio, segregation degrees of graphite powder and copper powder, and characteristics of the mixed powder.

TABLE 8

| Sample No. | Solid binder | Viscosity of liquid binder (cST) | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 18 | Ethylene-propylene | 7 | 99 | 0.01 | 0.25 | 3.43 | 23.1 | Inventive example |
| 19 | Ethylene-propylene | 15 | 100 | 0.02 | 0.22 | 3.45 | 24.7 | Inventive example |
| 20 | Ethylene-propylene | 26 | 100 | 0.03 | 0.18 | 3.38 | 24.4 | Inventive example |
| 21 | Ethylene-propylene | 80 | 100 | 0.01 | 0.16 | 3.17 | Not flow | Comparative example |

As is apparent from Table 8, when the viscosity of the fatty acid ester is changed, the graphite deposit ratio and the segregation preventive effect of the components are not changed. However, when the viscosity is more than 50 cST, the apparent density is reduced and the flowability is deteriorated. Accordingly, in the present invention, to ensure the smooth flow of the mixed powder without the generation of the bridging phenomenon upon feeding, the viscosity of the fatty acid ester is specified to be 50 cST at 100° F.

EXAMPLE 5

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, a fatty acid ester having an iodine number of 77 and a viscosity at 100° F. of 25 cST was added to the above mixed powder in an amount of 0.005 wt % (Sample No. 22), 0.02 wt % (Sample No. 23), 0.04 wt % (Sample No. 24), 0.08 wt % (Sample No. 25), 0.15 wt % (Sample No. 26) or 0.30 % (Sample No. 27) on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder in the manner as in Example 1 and the characteristics (apparent density and flowability) of the mixed powder were examined using the above secondary sample powder in the same manner as in Example 3. Table 9 shows the results of the graphite deposit ratio, segregation degrees of graphite powder and copper powder, and characteristics of the mixed powder.

TABLE 9

| Sample No. | Solid binder | Added amount of liquid binder (wt %) | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 22 | Ethylene-propylene | 0.005 | 100 | 0.02 | 0.28 | 3.44 | 23.4 | Comparative example |
| 23 | Ethylene-propylene | 0.02 | 100 | 0.03 | 0.19 | 3.45 | 24.5 | Inventive example |
| 24 | Ethylene-propylene | 0.04 | 100 | 0.03 | 0.15 | 3.47 | 24.1 | Inventive example |
| 25 | Ethylene-propylene | 0.08 | 100 | 0.02 | 0.12 | 3.48 | 23.7 | Inventive example |
| 26 | Ethylene-propylene | 0.15 | 100 | 0.01 | 0.11 | 3.35 | 24.8 | Inventive example |
| 27 | Ethylene-propylene | 0.30 | 100 | 0.00 | 0.12 | 3.19 | Not flow | Comparative example |

As is apparent from Table 9, when the added amount of the liquid binder is less than 0.01 wt % or less on the basis of the total amount of the mixed powder, the segregation preventive effect of copper powder becomes insufficient. When it is more than 0.2 wt %, the flowability of the mixed powder is deteriorated. Therefore, the added amount of the liquid binder is preferably in the range of from 0.01 to 0.2 wt %.

EXAMPLE 6

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, each of fatty acids, which have a constant viscosity (viscosity at 100° F.: 25 cST) and the iodine number of 2 (Sample No. 28), 7 (Sample No. 29), 12 (Sample No. 30), 17 (Sample No. 31) and 50 (Sample No. 32), was added to the above mixed powder in an amount of 0.08 wt % on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder in the same manner as in Example 1 and the characteristics (apparent density and flowability) of the mixed powder were examined using the above secondary sample powder in the same manner as in Example 3. Table 10 shows the results of the graphite deposit ratio, segregation degrees of graphite powder and copper powder, and characteristics of the mixed powder. In addition, in Table 10, there are shown the results of the sample (Sample No. 33) using only ethylene-propylene copolymer as a binder and the sample (Sample No. 34) using only the fatty acid ester.

TABLE 10

| Sample No. | Solid binder | Iodine number of liquid binder | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 28 | Ethylene-propylene | 2 | 100 | 0.02 | 0.22 | 3.44 | 24.0 | Inventive example |
| 29 | Ethylene-propylene | 7 | 99 | 0.01 | 0.19 | 3.42 | 23.4 | Inventive example |
| 30 | Ethylene-propylene | 12 | 100 | 0.03 | 0.17 | 3.47 | 24.9 | Inventive example |
| 31 | Ethylene-propylene | 17 | 100 | 0.03 | 0.20 | 3.39 | 28.2 | Comparative example |
| 32 | Ethylene-propylene | 50 | 100 | 0.02 | 0.19 | 3.35 | 27.4 | Comparative example |
| 33 | Ethylene-propylene | No addition | 100 | 0.03 | 0.32 | 3.45 | 22.5 | Inventive example |
| 34 | No addition | 17 | 66 | 0.03 | 0.20 | 3.39 | 32.0 | Comparative example |

As is apparent from Table 10, the solid binder composed of the ethylene-propylene copolymer in combination with the liquid binder composed of the fatty acid is very effective to improve the characteristics of the mixed powder.

Next, to examine the change of the characteristics of the mixed powder with time, Sample Nos. 28 to 32 were measured for the apparent density and the flowability under the condition of changing the elapsed days after the manufacture. The results are shown in Tables 11 and 12.

As is apparent from Tables 11 and 12, there is a close relationship between the iodine number of the fatty acid and the change in the characteristics of the mixed powder with time. In the sample powder using the fatty acid having the iodine number of 15 or less, the apparent density and the flowability is little changed after two months. On the contrary, in the sample powder using the fatty acid having the iodine number of more than 15, the apparent density is greatly reduced and the flowability is significantly deteriorated with time.

The iodine number is obtained by applying halogen to a sample (100 g), measuring the absorption amount of the halogen, and converting it in the iodine amount (g). For the fatty acid, like the above-described fatty acid ester, the iodine number is proportional to the amount of the unsaturated bonds. When the amount of the unsaturated bonds is increased, the unsaturated bonds react with oxygen. Namely, as the iodine number is higher in the fatty acid, the fatty acid is easily oxidized and deteriorated. This reduces the apparent density of the mixed powder and deteriorates the flowability thereof. In the present invention, the iodine number of the fatty acid is thus specified at 15 or less for suppressing the change in the apparent density and flowability of the mixed powder with time.

EXAMPLE 7

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, each of fatty acids, which have a constant iodine number of 2 and the viscosity at 100° F. of 7 cST (Sample No. 35), 18 cST (Sample No. 36), 30 cST (Sample No. 37) and 80 cST (Sample No. 38), was added to the above mixed powder in an amount of 0.08 wt % on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder in the manner as in Example 1 and the characteristics (apparent density and flowability) of the mixed powder were examined using the above secondary sample powder in the same manner as in Example 3. Table 13 shows the results of the graphite deposit ratio, segregation degrees of graphite powder and copper powder, and characteristics of the mixed powder.

TABLE 11

| Sample No. | Solid binder | Iodine number of liquid binder | Elapsed days after manufacture and apparent density (g/cm³) After 1 day | After 3 days | After 7 days | After 10 days | After 30 days | After 60 days | Remark |
|---|---|---|---|---|---|---|---|---|---|
| 28 | Ethylene-propylene | 4 | 3.42 | 3.44 | 3.45 | 3.46 | 3.44 | 3.45 | Inventive example |
| 29 | Ethylene-propylene | 7 | 3.41 | 3.42 | 3.40 | 3.41 | 3.38 | 3.40 | Inventive example |
| 30 | Ethylene-propylene | 12 | 3.46 | 3.47 | 3.47 | 3.42 | 3.44 | 3.41 | Inventive example |
| 31 | Ethylene-propylene | 17 | 3.39 | 3.39 | 3.36 | 3.20 | 3.12 | 3.04 | Comparative example |
| 32 | Ethylene-propylene | 50 | 3.41 | 3.35 | 3.29 | 3.24 | 3.21 | 3.18 | Comparative example |

TABLE 12

| Sample No. | Solid binder | Iodine number of liquid binder | Elapsed days after manufacture and flowability (sec/50 g) After 1 day | After 3 days | After 7 days | After 10 days | After 30 days | After 60 days | Remark |
|---|---|---|---|---|---|---|---|---|---|
| 28 | Ethylene-propylene | 2 | 23.7 | 24.0 | 24.2 | 23.8 | 23.9 | 24.3 | Inventive example |
| 29 | Ethylene-propylene | 7 | 23.1 | 23.4 | 23.5 | 23.7 | 23.1 | 23.4 | Inventive example |
| 30 | Ethylene-propylene | 12 | 24.8 | 24.9 | 24.9 | 25.1 | 25.4 | 26.5 | Inventive example |
| 31 | Ethylene-propylene | 17 | 26.1 | 28.2 | 30.1 | 32.2 | 34.0 | Not flow | Comparative example |
| 32 | Ethylene-propylene | 50 | 25.3 | 27.4 | 30.3 | 33.3 | Not flow | Not flow | Comparative example |

As is apparent from Table 13, when the viscosity of the fatty acid is changed, the graphite deposit ratio and the segregation preventive effect of the components are not changed. However, when the viscosity is more than 50 cST, the apparent density is reduced and the flowability is deteriorated. Accordingly, in the present invention, to ensure the smooth flow of the mixed powder without the generation of the bridging phenomenon upon feeding, the viscosity of the fatty acid is specified to be 50 cST at 100° F.

TABLE 13

| Sample No. | Solid binder | Viscosity of liquid binder (cST) | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 35 | Ethylene-propylene | 7 | 100 | 0.02 | 0.23 | 3.46 | 23.8 | Inventive example |
| 36 | Ethylene-propylene | 18 | 100 | 0.01 | 0.17 | 3.44 | 24.1 | Inventive example |
| 37 | Ethylene-propylene | 30 | 100 | 0.03 | 0.20 | 3.45 | 24.7 | Inventive example |
| 38 | Ethylene-propylene | 80 | 100 | 0.02 | 0.19 | 3.20 | Not flow | Comparative example |

EXAMPLE 8

The sample powder (Sample No. 3, mixing ratio between ethylene and propylene=20:80) prepared in Example 1 was agitated for several min. The mixer was then evacuated, and toluene was evaporated and dried while the mixed powder was agitated. After drying, a fatty acid having an iodine number of 7 and a viscosity at 100° F. of 25 cST was added to the above mixed powder in an amount of 0.005 wt % (Sample No. 39), 0.02 wt % (Sample No. 40), 0.04 wt % (Sample No. 41), 0.08 wt % (Sample No. 42), 0.15 wt % (Sample No. 43) or 0.30 wt % (Sample No. 44) on the basis of the total weight of the mixed powder, and was mixed for 6 min at 100 rpm, thus preparing the primary sample powder for measuring graphite deposit ratio.

Next, a lubricant (zinc stearate, average particle size: 30 μm) was added to the above mixed powder (primary sample powder) in an amount of 0.75 wt % on the basis of the total weight of the mixed powder, and mixed for 2 min at 100 rpm, thus preparing the secondary sample powder for examining the characteristics of the mixed powder and the segregation degrees of copper powder and graphite powder.

The graphite deposit ratio was measured using the above primary sample powder in the manner as in Example 1 and the characteristics (apparent density and flowability) of the mixed powder were examined using the above secondary sample powder in the same manner as in Example 3. Table 14 shows the results of the graphite deposit ratio, segregation degrees of graphite powder and copper powder, and characteristics of the mixed powder.

As is apparent from Table 14, when the added amount of the liquid binder is less than 0.01 wt % or less on the basis of the total amount of the mixed powder, the segregation preventive effect of copper powder becomes insufficient. When it is more than 0.2 wt %, the flowability of the mixed powder is deteriorated. Therefore, the added amount of the liquid binder is preferably in the range of from 0.01 to 0.2 wt %.

TABLE 14

| Sample No. | Solid binder | Added amount of liquid binder (wt %) | Graphite deposit ratio (%) | Segregation degree of graphite powder | Segregation degree of copper powder | Apparent density (g/cm$^3$) | Flow-ability (sec/50 g) | Remark |
|---|---|---|---|---|---|---|---|---|
| 39 | Ethylene-propylene | 0.005 | 100 | 0.02 | 0.31 | 3.47 | 23.5 | Comparative example |
| 40 | Ethylene-propylene | 0.02 | 99 | 0.03 | 0.19 | 3.42 | 23.4 | Inventive example |
| 41 | Ethylene-propylene | 0.04 | 100 | 0.01 | 0.16 | 3.44 | 24.7 | Inventive example |
| 42 | Ethylene-propylene | 0.08 | 100 | 0.02 | 0.11 | 3.42 | 25.1 | Inventive example |
| 43 | Ethylene-propylene | 0.15 | 100 | 0.01 | 0.10 | 3.32 | 25.8 | Inventive example |
| 44 | Ethylene-propylene | 0.30 | 100 | 0.00 | 0.10 | 3.17 | Not flow | Comparative example |

What is claimed is:

1. A mixed powder comprising:

(a) 0.05–0.5 wt. % of a binder; and (b) a metallurgical raw powder;

wherein said binder comprises a copolymer made from monomers comprising ethylene and propylene.

2. The mixed powder of claim 1, further comprising at least one liquid selected from the group consisting of a liquid fatty acid ester having an iodine number of 100 or less and a viscosity at 100° F. of 50 cST or less, and a liquid fatty acid having an iodine number of 15 or less and a viscosity of 100° F. of 50 cST or less.

3. The mixed powder of claim 1, wherein said monomers comprise 20–80 parts by weight of said ethylene, and 80–20 parts by weight of said propylene.

4. The mixed powder of claim 1, wherein said copolymer has a weight-average molecular weight in the range of 10,000 to 1,000,000.

5. The mixed powder of claim 2, wherein said mixed powder comprises 0.01–0.2 wt. % of said liquid.

6. The mixed powder of claim 1, wherein said metallurgical raw powder comprises a metal and graphite.

7. The mixed powder of claim 6, wherein said metallurgical raw powder further comprises a lubricant.

8. The mixed powder of claim 6, wherein said metal is iron or steel.

9. The mixed powder of claim 6, wherein said metallurgical raw powder further comprises an alloy powder.

10. The mixed powder of claim 9, wherein said alloy powder is one powder selected from the group consisting of copper, nickel, chromium, molybdenum, phosphorus and sulfur.

11. The mixed powder of claim 1, wherein said copolymer has a weight-average molecular weight of 50,000 to 500,000.

12. The mixed powder of claim 1, further comprising a higher fatty acid selected from the group consisting of lauric acid, steric acid, olein acid, erucic acid, ricinolic acid and hydroxysteric acid; or an ester of said higher fatty acid and an alcohol, wherein said alcohol is selected from the group consisting of oleyl alcohol, stearlyalcohol, ethylene glycol, propylene glycol, glycerol, sorbitan, pentaerythritol, dipentaerythritol and trimethylolpropane.

13. A powder comprising:

(a) a copolymer made from monomers comprising ethylene and propylene;

(b) iron or steel powder; and (c) graphite.

14. The powder of claim 13, further comprising (d) at least one liquid selected from the group consisting of a liquid fatty acid ester having an iodine number of 100 or less and a viscosity of 100° F. of 50 cST or less, and a liquid fatty acid having an iodine number of 15 or less and a viscosity at 100° F. of 50 cST or less.

15. The powder of claim 13, further comprising (e) an alloy powder.

16. The powder of claim 13, further comprising (f) a lubricant.

* * * * *